United States Patent [19]

Banks

[11] 4,437,585

[45] Mar. 20, 1984

[54] DISPENSERS

[75] Inventor: Stewart Banks, Derby, England

[73] Assignee: Appor Limited, Derby, England

[21] Appl. No.: 242,870

[22] Filed: Mar. 12, 1981

[30] Foreign Application Priority Data

Mar. 15, 1980 [GB] United Kingdom ..... 8008837

[51] Int. Cl.[3] ..... B67D 5/06

[52] U.S. Cl. ..... 222/181; 222/309; 248/201; 248/221.3

[58] Field of Search ..... 70/120; 221/283; 222/173, 180, 181, 182, 185, 309; 248/220.2, 221.3, 222.1, 223.4, 553, 201, 216.4

[56] References Cited

U.S. PATENT DOCUMENTS

| | | | |
|---|---|---|---|
| 813,537 | 2/1906 | Townsend | 248/221.3 |
| 1,743,831 | 1/1930 | Schurr | 248/221.3 |
| 2,599,686 | 6/1952 | Bowman | 222/309 |
| 2,605,021 | 7/1952 | Churchill et al. | 222/478 X |
| 3,250,438 | 5/1966 | Packwood | 222/181 |
| 4,036,406 | 7/1977 | Jaspersen et al. | 222/309 |

*Primary Examiner*—Joseph J. Rolla

*Attorney, Agent, or Firm*—Alan H. Levine

[57] ABSTRACT

A dispenser including a dispensing mechanism (8) having a plunger (14) slidable relative to a barrel (15). The quantity of product dispensed is varied according to inward travel of the plunger (14) and this is adjusted by rotation of a screw (19) altering the position of a collar (18). The screw is accessible from externally of the dispenser but only when the dispenser is removed from a wall. The dispenser cannot be removed from the wall except by inserting a tool through an access opening (32) in a mounting and locking arrangement whereby to release a latch (30).

5 Claims, 3 Drawing Figures

DISPENSERS

This invention relates to dispensing apparatus and is particularly, but not exclusively, applicable to dispensers for soap, hand cleansers or the like.

Apparatus for dispensing liquid soap installed in toilets, washrooms and the like is subject to damage by vandals. Some means therefore requires to be provided to prevent interference with or unauthorised adjustment of the dispenser or its contents and to present removal of the dispenser from the supporting structure upon which it is mounted.

According to one aspect of the present invention there is provided a dispenser including a delivery mechanism for dispensing measured quantities of material contained in the dispenser, means for adjusting the measured quantity dispensed at each operation of the dispenser, and means mounting the adjustment to be accessible from externally of the dispenser at a rear location thereof, so as to enable the dispenser to be mounted on a wall or other support with the adjustment means inaccessible to an operator until the dispenser is removed from the wall or other support, the dispenser including a separable mounting plate adapted to be secured to a supporting structure and having means for slidably receiving the dispenser so as to mount the same on the mounting plate, and releasable latch means being provided to enable disengagement of the dispenser from the mounting plate whereby to permit access to said adjustment means, said latch means comprising a resilient projection carried by said mounting plate and resiliently biased into a locking position in which it engages with a portion of the dispenser, the projection being resiliently deformable away from said locking position to a retracted release position by use of a special tool engageable with the latch member through an access opening formed in the dispenser or in the mounting plate.

Advantageously, the latching projection may comprise a plurality of separate portions each independently biased to said locking position whereby the latch member may be released only by movement of both or all of said portions to the release position.

Thus according to a further aspect of the invention there is provided a mounting and locking device for a dispenser comprising a mounting plate, means on the mounting plate for slidably receiving a dispenser so as to mount same on the mounting plate, and latch means associated with a portion of the mounting plate which is obscured by the dispenser when the latter is mounted on the mounting plate, the latch means being adapted in an operative locking position to engage with a portion of the dispenser to prevent removal of the dispenser from the mounting plate and the latch means comprising a plurality of separately releasable members both or all of which are movable through an access opening formed in the dispenser or the mounting plate to a release position to enable detachment of the dispenser from the mounting plate.

An embodiment of the invention will now be described, by way of example only, with reference to the accompanying drawings, in which FIG. 1 is a vertical cross-section through one form of dispensing apparatus according to the invention;

Figure 1:
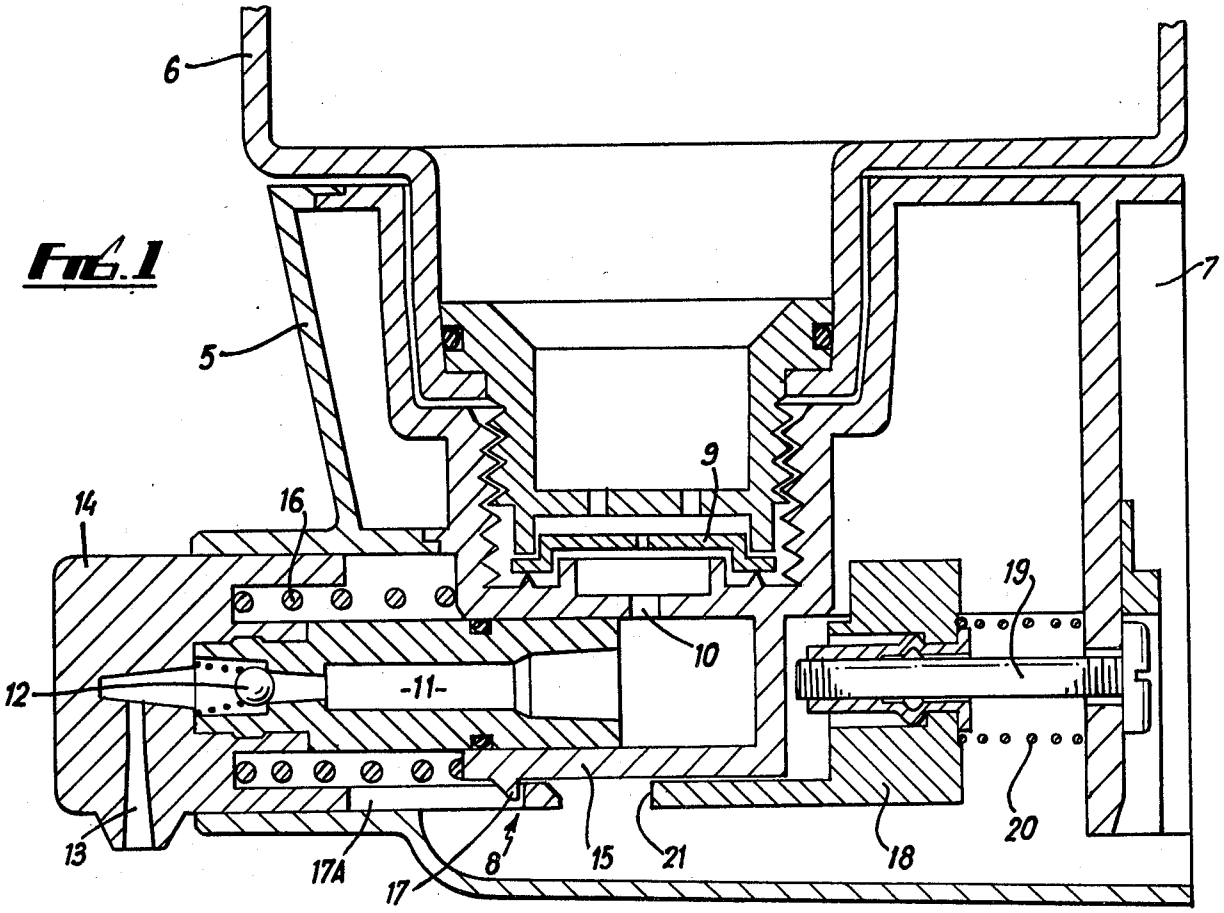

Referring to the drawings, the dispenser includes a housing 5 adapted to detachably receive a container 6 of soap or other product to be dispensed. A back plate 7 is formed integrally with the housing 5 and a dispensing mechanism 8 is disposed beneath the housing to enable measured quantities of soap or the like to be dispensed from the container 6.

The housing also includes a one-way valve 9 controlling the entrance to a passage 10 which communicates with a central passage 11 in the dispensing mechanism connected by a one-way valve 12 to an outlet passage 13. The dispensing mechanism includes a plunger 14 slidably mounted in a barrel or casing 15 within the housing 5 and resiliently biased by a spring 16 to an inoperative position shown in the drawing. A stop member 17 formed on the barrel 15 engages with a slot 17A in the underside of the plunger 14 to limit the outward movement of the plunger.

Also slidably mounted on the barrel 15 is a collar 18, the rear or right hand face of which as viewed in FIG. 1 is engaged by a screw 19 passing through an aperture in the back plate 7. A spring 20 surrounds the screw 19 and acts between the forward face of the back plate 7 and the rear face of the collar 18 to urge the latter towards the left in FIG. 1. The forward end face 21 of the collar acts as an abutment to limit inward or rearward movement of the plunger 14. Such movement causes engagement of the rear of the plunger with the face 21 thereby moving the collar 18 and screw 19 rearwards till the head of the screw abuts a mounting plate by means of which the dispenser is mounted on a wall or the like and which is described hereafter. Further movement of the plunger is then prevented and hence by adjustment of the screw 19 the extent of travel of the plunger 14 can be adjusted, thereby varying the quantity of product dispensed.

In use of the dispenser, the plunger 14 is pressed inwardly and released which creates a vacuum in the passages 10 and 11, thereby drawing soap from the container 6 through the valve 9 into the passages 10 and 11 to prime the dispensing mechanism. Subsequent depression of the plunger 14 causes the valve 9 to close thereby pressurising the soap in the passages 10 and 11 and causing it to force open the valve 12 and discharge from the dispenser through the outlet passage 13. At the same time, further soap is drawn from the container 6 into the passages 10 and 11 thereby priming the dispenser for further use.

The quantity of soap delivered is determined by the extent of travel of the plunger 14 and this may be adjusted by rotating the screw 19 to alter the position of the collar 18. It should be noted also that the head of the screw 19 is disposed behind the back plate 7 and is therefore inaccessible when the dispenser is mounted on a wall or other suitable support. This is particularly advantageous in that it prevents unauthorised adjustment of the dispenser which requires to be removed from the wall before adjustment can be effected.

Figure 3:
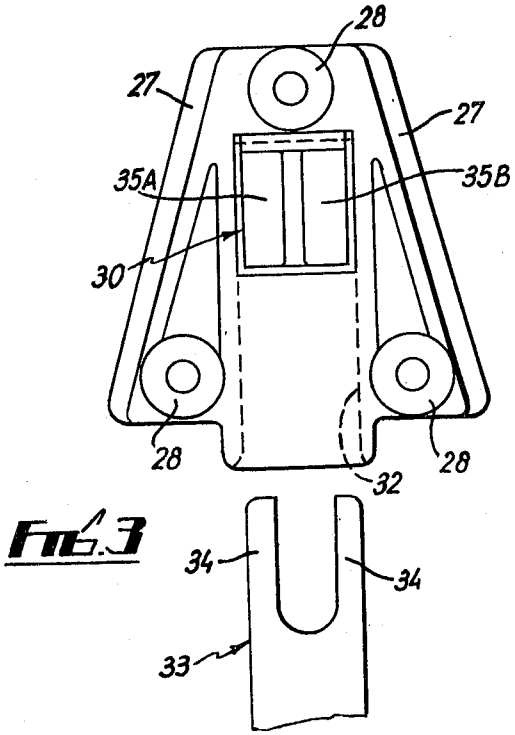
FIG. 3 is a rear view of a mounting plate by means of which the dispenser may be mounted on a wall or other suitable support, and also showing a tool for use in releasing the dispenser from the mounting plate.
Figure 2:
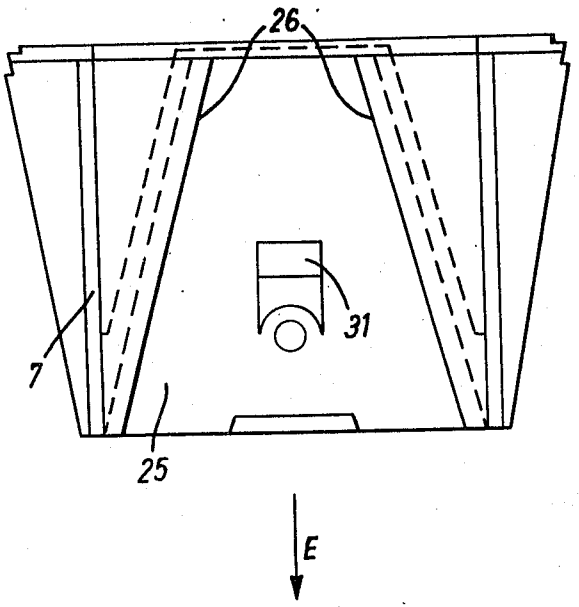
FIG. 2 is a rear view of the apparatus shown in FIG. 1.

In order to facilitate removal of the dispenser for the purpose of adjusting the screw 19 while at the same time ensuring that it cannot readily be removed by unauthorised persons, a mounting plate incorporating a locking mechanism is provided to mount the dispenser on a wall or the like. Referring to FIGS. 2 and 3 the back plate 7 incorporates a recess 25 in its rear face having inclined edges 26 which are undercut to form channels which are adapted to locate on complementary flanges 27 formed on the mounting plate shown in FIG. 3. The mounting plate is provided with three cylindrical bosses 28 through which screws or the like can be passed to secure the plate to a wall or the like and the dispenser may then be slidingly engaged with the mounting plate by moving it downwards on to the plate as indicated by the arrow E in FIG. 2.

In order to lock the dispenser on the mounting plate a latch member in the form of a resilient projection 30 is provided on the mounting plate and normally projects forwardly therefrom for engagement with a abut-ment 31 on the back plate 7 of the dispenser. Thus when the dispenser is engaged with the mounting plate the latch 30 springs forwardly into engagement with the abutment 31 and prevents upward movement of the dispenser. In order to enable release of the latch, a channel 32 is provided in the portion of the mounting plate beneath the latch 30 and permits insertion of a tool 33 which moves the latch clear of the abutment 31 and enables the dispenser to be withdrawn from the mounting plate. For this purpose the lower edge of the latch 30 and the prongs 34 of the tool are oppositely chamfered to enable the tool to slide beneath the latch and lift it clear of the abutment 31.

It will be noted that the latch consists of two parallel portions 35A and 35 B and the tool 33 has two spaced prongs 34 one of which engages with each portion of the latch. This ensures that the dispenser cannot be released by inserting a simple pointed instrument since this would deflect one portion of the latch only and fail to release it. Simultaneous disengagement of both portions of the latch is necessary before the dispenser is released from the mounting plate.

By virtue of the arrangement described it is possible to adjust the quantity of produce dispensed at each operation of the dispenser and the adjustment means is protected from unauthorized use by virtue of the fact that it is inaccessible when the dispenser is mounted on a wall or the like. Moreover, by virtue of the particular form of mounting plate provided the dispenser can be readily detached for adjustment or other purposes by use of the appropriate special tool but cannot be readily detached by unauthorised persons. This not only ensures that the adjustment means cannot be tampered with, but protects the dispenser as a whole against vandalism in so far as it cannot be readily detached from the wall.

Various modifications may be made without departing from the invention. For example, the concealed adjustment device could be provided without the mounting plate or vice versa and each of these aspects of the dispenser constitutes a separate invention in its own right. The manner of operation of the adjustment device could also be varied provided the means for operating it was obscured by the dispenser when mounted on a wall or the like. The mounting plate, where provided, could also vary substantially provided it includes a locking device which is obscured by the dispenser and can only be released by use of a special tool. Moreover, while reference has been made primarily to the dispensing of soap it should be appreciated that the invention is applicable to dispensers for dispensing any products in liquid, gel, paste, powder or like form.

I claim:

1. A dispenser including a delivery mechanism for dispensing measured quantities of material contained in the dispenser, means for adjusting the measured quantity dispensed at each operation of the dispenser, and means mounting the adjustment to be accessible from externally of the dispenser at a rear location thereof, so that when the dispenser is mounted on a wall or other support the adjustment means is inaccessible to an operator until the dispenser is removed from the wall or other support, the dispenser including a separable mounting plate adapted to be secured to a supporting structure and having means for slidably receiving the dispenser so as to mount the same on the mounting plate, and releasable latch means being provided to enable disengagement of the dispenser from the mounting plate whereby to permit access to said adjustment means, said latch means comprising a resilient projection carried by said mounting plate and resiliently biased into a locking position in which it engages with a portion of the dispenser, the projection being resiliently deformable away from said locking position to a retracted release position by use of a special tool engageable with the latch member through an access opening formed in the dispenser or in the mounting plate.

2. A mounting and locking device for a dispenser comprising a mounting plate, means on the mounting plate for slidably receiving a dispenser so as to mount same on the mounting plate, and latch means associated with a portion of the mounting plate which is obscured by the dispenser when the latter is mounted on the mounting plate, the latch means being adapted in an operative locking position to engage with a portion of the dispenser to prevent removal of the dispenser from the mounting plate and the latch means comprising a plurality of separately releaseable members each of which is movable upon manipulation thereof through an access opening formed in the dispenser or the mounting plate to a release position to enable detachment of the dispenser from the mounting plate.

3. A device according to claim 2 wherein said separately releasable members comprise resilient projections carried by said mounting plate and resiliently biased into locking positions in which they engage with an abutment on the dispenser, said projections being resiliently deformable away from said locking positions to retracted release positions by use of a special tool engageable with the projects through the access opening.

4. A device according to claim 3 wherein said projections are disposed side by side and said tool comprises a fork having spaced prongs engageable with respective ones of said projections.

5. A device according to claim 4 wherein the free edges of said projections and the prongs of said fork are oppositely chamfered to enable the fork to slide beneath the projections and move them clear of said abutment.

* * * * *